United States Patent [19]

Rias

[11] 4,444,311

[45] Apr. 24, 1984

[54] MULTI-ROLL PACKAGE OF COMPRESSIBLE MATERIALS

[75] Inventor: Jean-Claude Rias, Villennes sur Seine, France

[73] Assignee: Isover Saint-Gobain, Paris, France

[21] Appl. No.: 422,283

[22] Filed: Sep. 23, 1982

Related U.S. Application Data

[63] Continuation of Ser. No. 217,001, Mar. 9, 1981, abandoned.

[30] Foreign Application Priority Data

Jul. 9, 1979 [FR] France ..... 79 17771

[51] Int. Cl.[3] ..... B65D 85/20

[52] U.S. Cl. ..... 206/391; 206/443; 206/596; 206/597; 206/417

[58] Field of Search ..... 206/391–393, 206/413–416, 417, 443, 595, 596, 597, 598; 100/1, 3

[56] References Cited

U.S. PATENT DOCUMENTS

| | | | |
|---|---|---|---|
| 175,404 | 3/1876 | Adamson | 206/417 |
| 3,272,329 | 9/1966 | Mehalov | 206/65 |
| 3,288,311 | 11/1966 | Beattie | 206/443 |
| 3,587,201 | 6/1971 | Strayer | 53/24 |
| 3,638,790 | 2/1972 | Schmid et al. | 206/65 S |
| 3,764,351 | 10/1973 | Whittington et al. | 206/443 |
| 4,036,364 | 7/1977 | Ambrose | 206/526 |
| 4,195,732 | 4/1980 | Bell | 206/597 |

FOREIGN PATENT DOCUMENTS

| | | | |
|---|---|---|---|
| 519119 | 4/1929 | Fed. Rep. of Germany | 206/443 |
| 2631817 | 1/1978 | Fed. Rep. of Germany . | |
| 1579675 | 7/1969 | France . | |
| 2188572 | 1/1974 | France . | |
| 2216811 | 8/1974 | France . | |
| 2437994 | 4/1980 | France . | |

*Primary Examiner*—Joseph Man-Fu Moy
*Attorney, Agent, or Firm*—John T. Synnestvedt; Kenneth P. Synnestvedt

[57] ABSTRACT

The invention concerns a package of at least two layers of rolls of a compressible material.

In this package, the rolls of each layer are placed side by side and in mutual contact, while the rolls of two superposed layers are in mutual contact along their lowermost or uppermost surfaces. In addition, the package contains two contoured panels adjacent the outer layers of the rolls, and two bindings bearing on the contoured panels and orthogonally arranged with respect to each other.

The invention applies in particular to the packaging of rolls of fibrous insulating materials.

13 Claims, 5 Drawing Figures

MULTI-ROLL PACKAGE OF COMPRESSIBLE MATERIALS

This application is a continuation of application Ser. No. 217,001, filed 3/9/81, now abandoned.

The present invention concerns a process and apparatus for forming packages of compressible materials, in particular fibrous insulating materials in the form of rolls.

Various packagings of rolled materials, which may be employed either with individual rolls or with rolls assembled side by side, are known. The packaging in these various known cases is generally made up of one or several sheets of paper folded down on the ends of the roll or of the assembly, or of sheets of plastic material of the polyethylene type, usually shrunk by thermal treatment. These various types of packaging units are no longer suitable for satisfactorily responding to the needs of the users in the construction field, since very large quantities of products are transported from the production plant to the points of use.

In the case of light materials, such as insulating materials, the necessary volume of such materials in storage can reach a third of the total storage volume of the construction materials handled by the users. Up to now, the technique of palettization resolved the problems posed by the handling of heavy materials, such as bricks, cement, etc. . . . , however the use of confined palettes, and also the use of confined containers, involves the problem of recovery of the palettes with risks of damage to the palettes, and with resulting division of responsibility. This system has not been used up to now for light materials.

As far as rolls of light materials are concerned, the solution proposed for handling such materials was to group several dozen roll units, such as the individual insulating rolls above referred to, so as to make up a package, cubical for example, capable of exceeding the volume of 15$m^3$, and a weight of several hundred kilos. However, this volume and weight makes the handling of such packages difficult, unless specific and expensive handling means are used at the production plant, in the storage warehouses and at the premises where the materials are used. Because of these factors, handling means, such as cranes or lifts, are indespensable for accomplishing the handling, and this generally leads to expensive investments. Furthermore, the size of these rolls is such that they cannot be stored in ordinary warehouses, which very often are equipped with bins, racks or attics of insufficient dimensions.

Such voluminous rolls could also be stored in the open. However, they would then have to be water and air tight and weather resistant (frost, rain and sunning), which would increase their cost prohibitively.

It has also been proposed to produce packages in which elastic insulating products are collected in compressed form. Packages of this type are known, in which compressed, fibrous, insulating panels are stacked one on top of the other (French patent No. 2,216,811). Other packages of this type contain tubular, fibrous products, such as insulating ducts or pipes, stacked in the flattened state (U.S. Pat. No. 3,587,201). Such modes of packaging are not useable with insulating materials of the kind mentioned, due to the fact that these materials cannot be reduced to such a state of compression without adverse effects.

The aim of the invention is to overcome these disadvantages by providing a new type of multi-roll package of a compressible material, in particular insulating rolls, in which the compressible material is only subjected to a limited compression, in order to avoid its permanent deformation, and which lends to the handling of the packages by conventional apparatus such as fork lifts, and which packages can be stacked for storage.

For these purposes, the object of the invention is to provide a package of at least two layers of rolls of a compressible material, the rolls of each layer being placed side by side and in mutual contact, while lower and upper rolls of two superposed layers vertically overlie each other and are in mutual contact along their lowermost and uppermost surfaces, this package being characterized in that it contains:

two contoured panels adjacent the outer sides of the layers of the rolls, and two bindings bearing on the contoured panels and orthogonally arranged with respect to each other.

Preferably, a covering of paper or of stretchable or shrinkable plastic material will envelope the rolls, the panels and the bindings, to protect the unit from inclemencies and to improve the overall form of the package.

Advantageously, said contoured panels will be joined by transversal panels to form one of said bindings, whereas plastic bands or strips will make up the second bindings, perpendicular to the first bindings.

According to one important characteristic of the invention, the contoured panels adjoining two opposite sides of the package will each have two recesses for the fork of a handling apparatus, these recesses resulting from folding or casting of the material of which these panels are composed. Of course, the transversal panels in this case will have perforations for the passage of said fork, or will have definative marked areas which the fork will perforate during the handling of the package.

The object of the invention is also to provide a process of making such a package, characterized in that:

a first layer of rolls arranged side by side and in mutual contact is placed on a contoured panel;

at least one other layer formed like the first layer is stacked on the first layer, the rolls of the second layer being in contact along their lowermost surfaces with the uppermost surfaces of the rolls of the first layer;

a contoured panel is placed on the stack and the stack is compressed between the two contoured panels; and the stack maintained in the compressed state is bound with straps bearing on said panels and forming two bindings orthogonally directed in relation to each other.

Preferably, the assembly thus formed is next enveloped with a paper covering or with stretchable or shrinkable plastic material.

The object of the invention is also to provide an apparatus for implementing the process, this apparatus being characterized in that it contains:

a base for the lower contoured panel and the stack of multi-roll layers;

an upper platform, which is movable with respect to the base under the influence of the compression means used; and side supports constituting a structure defining a maximum package size.

Said base will preferably contain individual supports for the rolls of the first layer, said individual supports being adjustable in position with regard to each other, so that they may be adapted to rolls of varying sizes.

These supports will preferably have a cross section having the form of the roll surfaces.

The side supports, which define the maximum structure, will preferably be adjustable in position with regard to each other. Advantageously, these supports will contain openings to accommodate sheets or similar binding elements.

Finally, a last object of the invention is constituted by the application of said packages to the storage of rolls of compressible material, by stacking said packages in piles containing a plurality of the packages.

The attached drawings illustrate the implementation of the invention. On these drawings.

Figure 1:
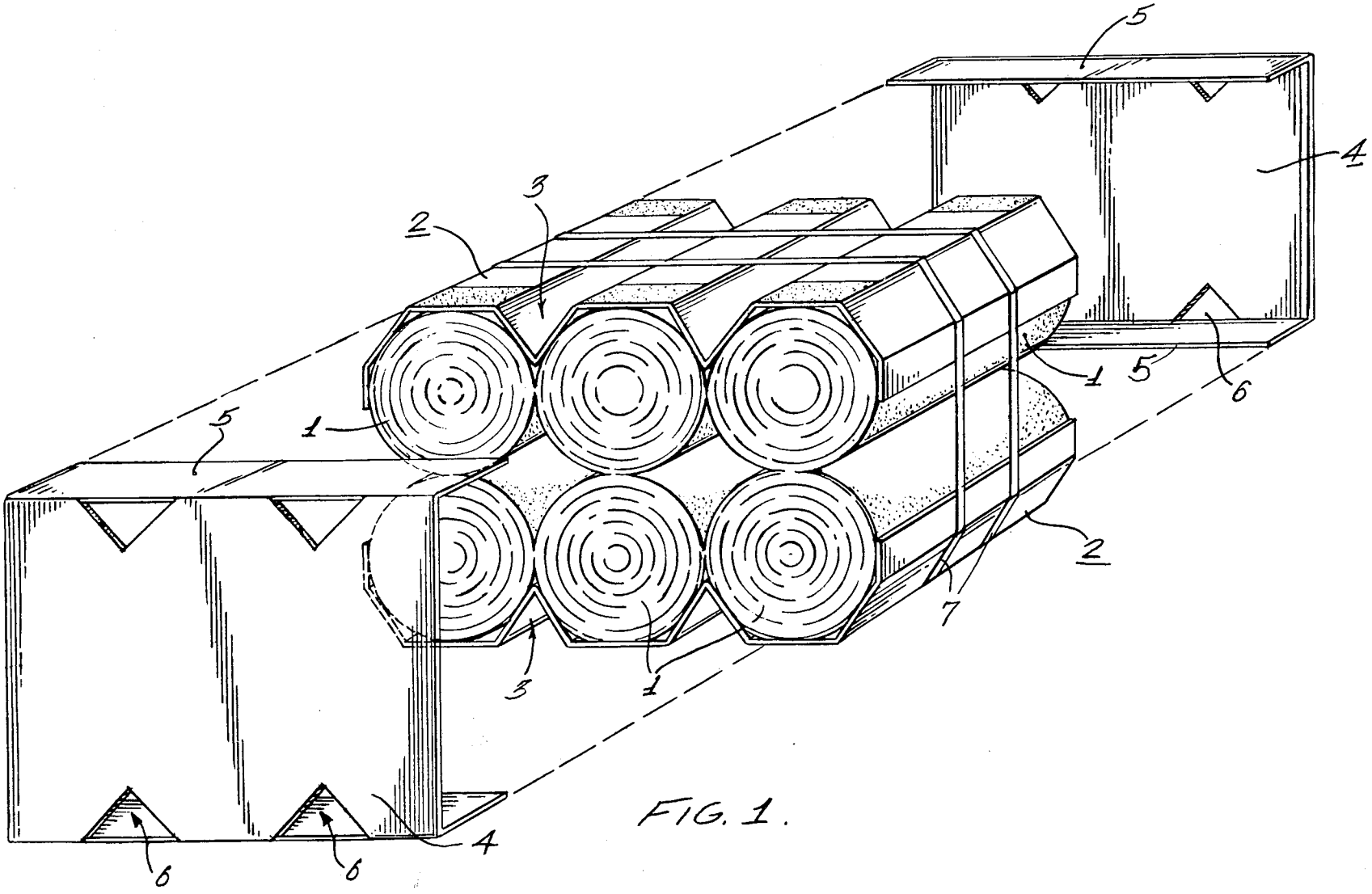
FIG. 1 is a sectional view in perspective of a package of six rolls.
Figure 2:
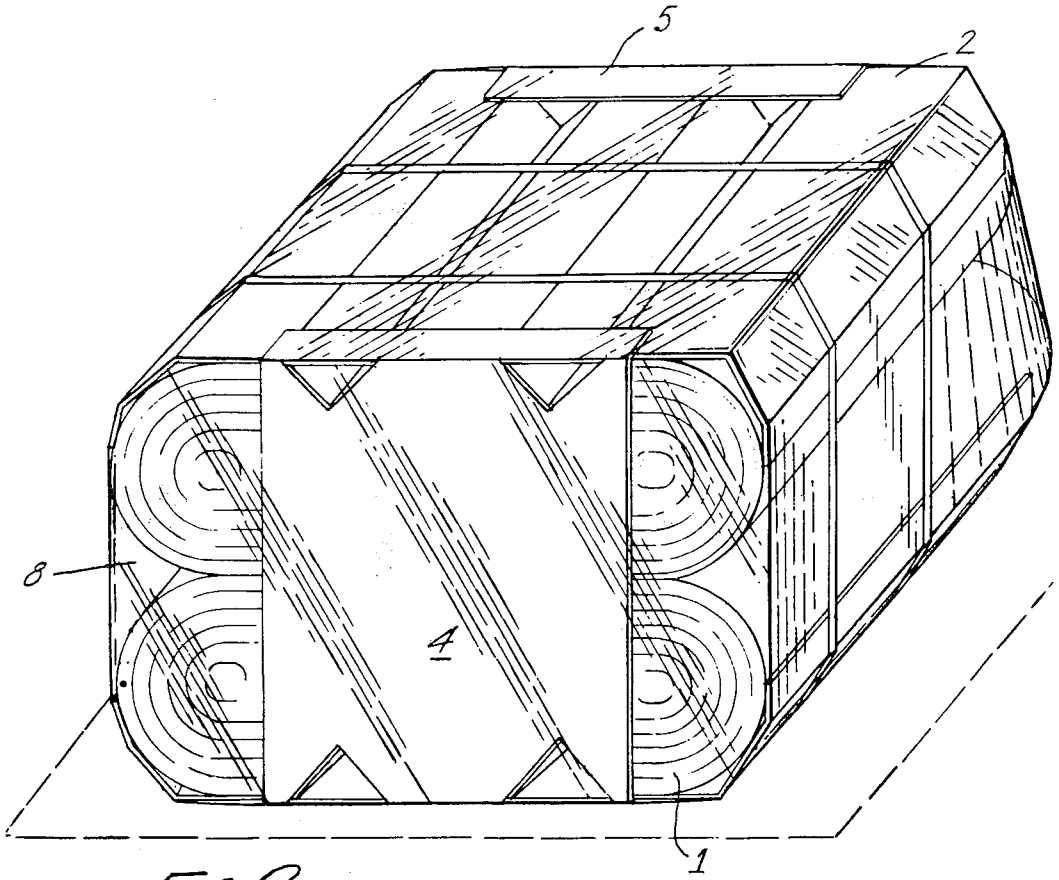
FIG. 2 is a view in perspective of the package shown in FIG. 1.

The package in accordance with the invention shown in FIGS. 1 and 2 is made up of six rolls 1 of a compressible material, for example, a fibrous thermal insulating material. These rolls are grouped in two superimposed layers each containing three rolls, the rolls of the lower layer being placed parallel and in mutual contact, whereas the rolls of the upper layer rest on the rolls of the lower layer with the uppermost and lowermost surfaces in contact.

The rolls of the lower layer are supported by a panel 2 cast of a plastic material or formed of cardboard, which is contoured to assume the form of rolls 1 and provide triangular recesses 3 for a fork of a handling apparatus.

Analogously, an identical panel 2 covers the rolls of the upper layer.

Panels 4, also of plastic material or of cardboard, are placed against the ends of the rolls 1 and are bonded to the panels 2 by flanges 5 glued to the panels 2. These panels 2 and the panels 4 thus form a first binding enclosing the rolls 1. The panels 4 contain cut-outs 6 in registry with recesses 3 of the contoured panels 2.

A second binding, orthogonal to the one first described, is formed by two strips 7 of plastic material, for example of polypropylene, which surround the rolls 1 perpendicular to their axes.

Finally, a covering 8 of a shrinkable material, for example polyethylene of a thickness of from 0.07 mm to 0.15 mm, encloses the assembly formed by the rolls 1, the contoured panels 2, the panels 4 and the strips 7.

The binding formed by the panels 2 and the panels 4 maintain in height the assembly of rolls 1 and prevent lateral deformation, whereas the encircling with strips 7 prevents the longitudinal sliding of the rolls. The covering 8 of shrinkable material protects the package from inclemencies.

Figure 3:
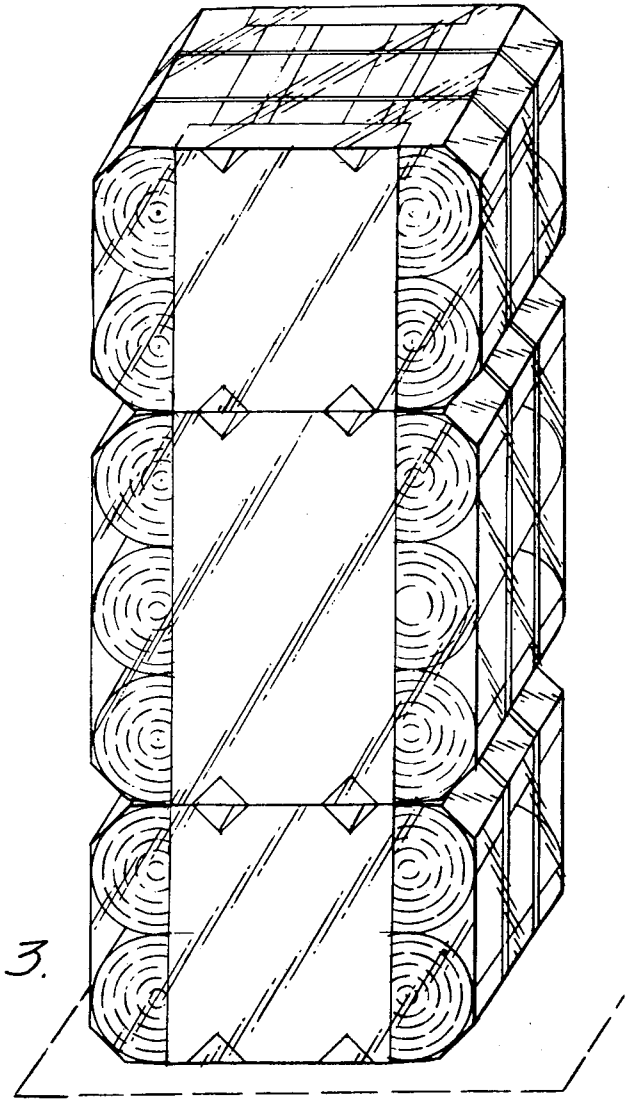
FIG. 3 illustrates the stacking of a plurality of packages of six and nine rolls.

For the handling of such a package with a fork lift, it will be sufficient to perforate the covering 8 with the fork and to engage the teeth of the latter in the cut-outs 6 of the panels 4 and the recesses 3 of the panels 2. It is thus possible to easily stack several packages, identical or not, on top of each other, as is seen in Figure 3. Packages of six or nine rolls, or even more, can be formed. For instance, FIG. 3 shows a stack of packages of six and nine rolls. The applicant thus embodied packages of rolls of fibrous thermal insulating material, presenting the following characteristics:

Packages of six rolls:
diameter of the rolls: 500 to 550 millimeters,
length of the package: 1600 mm,
width: (length of the rolls): 1200 mm,
height of the package: 860 mm,
weight of the package: about 95 kg.
Three packages of this type can be stacked, totalling 18 rolls.

Packages of nine rolls:
diameter of the rolls: 500 to 550 millimeters,
length of the package: 1600 mm,
width: (length of the rolls): 1200 mm,
height of the package: 1280 mm,
weight of the package: about 145 kg.
Two packages of this type can be stacked, totalling 18 rolls, as in the preceding case.

In practice, to reduce the volume of the package and to increase its mechanical endurance, the rolls 1 are compressed under a pressure lower than that which would cause their permanent deformation, before being assembled by the orthogonal bindings.

In the case of thermal insulation rolls, the characteristics of which were just given, these rolls are, in general, compressed so as to cause a reduction of their diameter of 10 to 25%, which corresponds to a pressure of 1000 to 2200 Pa. For instance, a pressure of 1550 Pa (corresponding to a stress of 250 kg) causes a diameter reduction of 17%.

Figure 5:
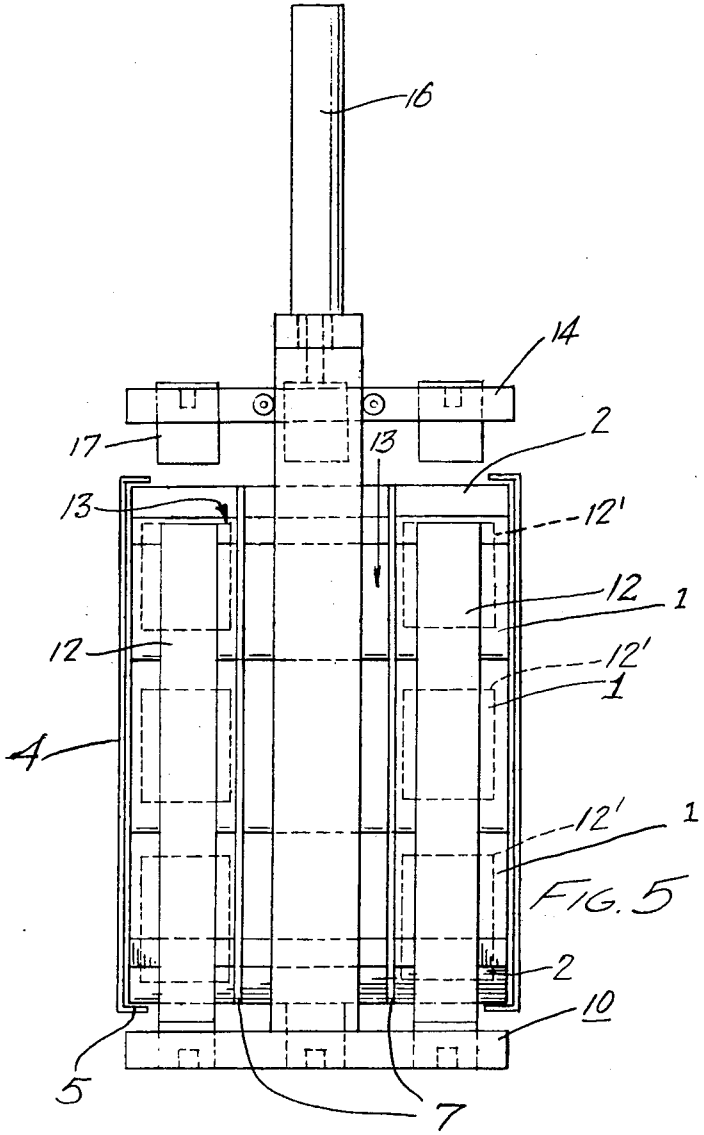
FIGS. 4 and 5 are two elevational views, one from the front and the other from the side, of an apparatus for implementation of the invention.
Figure 4:
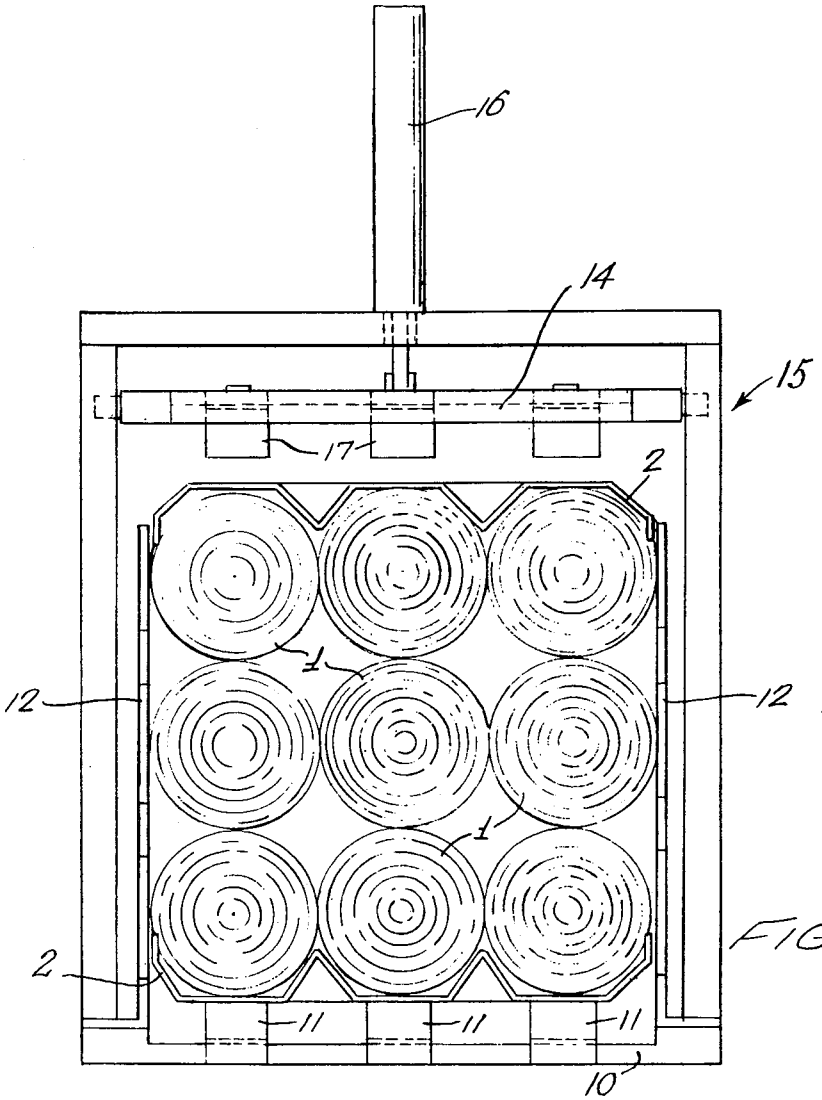

In order to embody the packages according to the invention and to compress the multi-roll parcels, the apparatus schematically shown in FIGS. 4 and 5 will be advantageously utilized.

This apparatus contains a base 10, equipped with supports 11 adjustable in position, side walls formed by vertical plates 12, or preferably of plates 12' shown as broken lines in FIG. 5 separated by gaps 13, and an upper platform 14, parallel to the base 10 and capable of being displaced with regard to the latter on a frame 15 under the effect of a jack 16. The platform 14 is equipped with support blocks 17.

A panel 2, previously contoured, rests on the supports 11, of which the position was regulated so that each of the supports was perpendicular to a roll 1. The various layers of rolls are stacked and the last one is covered with a panel 2, identical to the one first mentioned. With platform 14 and ]ack 15 the multi-roll parcel is then lightly compressed to the desired volume and the platform 14 is maintained in this position.

It is then possible to encircle the rolls with strips 7 by introducing these strips through the spaces 13 which separate the plates 12. Finally, the flanges 5 of the panels 4 are glued on the ends of the lower and upper panels 2. This gluing can also be achieved before the encircling of the rolls.

The multi-roll parcel is then withdrawn from the compression apparatus and it is enveloped with a shrinkable polyethylene covering 8, before passing the unit into a shrinking oven.

Due to the compression of the rolls, prior to their assembly, the contoured panels 2 and the panels 4 work in tension when the pressure exerted during the formation of the package is relieved, at the same time that a stiffening effect is exerted by the panels 4 on the stack. This precompression also makes the panels 2 and the panels 4 particularly suitable to resist compression when the packages are stacked and when they support the weight of other packages.

Naturally, any other means known in the art and suitable to fulfill the same functions could be substituted for the panels 4.

The invention, therefore, proposes a particularly simple process for the formation of multi-roll packages of a compressible material, thermal insulation rolls in particular, which favor the handling and storage of these packages without it being necessary to resort to palettes and to large storage areas.

It should be noted that it is easy, for the user, to remove the rolls from the packages just described and that the constituent materials of these packages are not very voluminous, are inexpensive and are easily destroyed after utilization.

The process according to the invention is transposable to articles of compressible material not being in the form of rolls, for example to substantially parallelepipedal blocks of plastic foam material, or even to packets of thermal insulating materials, provided that the form of these articles enables the use of the contoured outer panels, having recesses for the teeth of a fork of a handling apparatus.

Such an application of this process enters into the scope of the present invention.

I claim:

1. A package comprising an assembly of at least two superposed layers of rolls of a compressible material, the rolls of each layer being placed side-by-side with their axes in a common plane and the rolls of each pair of adjoining rolls in each layer being in direct contact with each other, characterized in that:

the rolls of adjacent superposed layers are in direct contact with each other along the lowermost and uppermost surfaces thereof and are compressed against each other to provide a roll package of predetermined height;

two contoured panels respectively adjoin the upper surfaces of the uppermost layer and the lower surfaces of the lowermost layer of the compressed rolls;

a first binding comprising panels overlying the ends of the rolls and having flanges with flange surfaces overlying and secured to end portions of the contoured panels and forming in combination with the contoured panels a binding extending around the assembly in a plane paralleling the axes of the rolls;

the panels at the ends of the assembly of rolls having a dimension in the direction of superposing of the layers of rolls, which dimension is smaller than the uncompressed layers of rolls, thereby maintaining the rolls of the assembly in partially compressed condition and establishing an assembly of said predetermined height; and a second binding comprising at least one strip extended around the assembly of rolls in a plane perpendicular to the axes of the rolls.

2. A package according to claim 1, characterized in that it contains two identical contoured panels.

3. A package according to claim 1 or 2, characterized in that the contoured panels are formed of sheet material and have two recesses for a fork lift.

4. A package according to claims 1 or 2, characterized by contoured panels of which the section in contact with the rolls substantially takes the form of the contacted portions of the rolls.

5. A package according to claims 1 or 2, characterized in that it contains panels at the ends of the assembly connected to the contoured panels to make up one of the package bindings.

6. A package according to claim 3, characterized in that the binding panels have cut-outs adjacent to the panel flanges and registering with the fork lift recesses provided in the contoured panels.

7. A package according to claim 3, characterized in that the binding panels have, opposite fork lift recesses provided in the contoured panels, predetermined marked areas which the fork lift penetrates during the lifting of the package.

8. A package according to claim 1 or 2, characterized in that the second binding is formed of plastic strips.

9. A package according to claim 6, characterized in that the second binding is formed of plastic strips.

10. A package according to claim 7, characterized in that the second binding is formed of plastic strips.

11. A package according to claim 1 or 2, characterized in that it includes an outer covering of paper or of a stretchable or shrinkable plastic material.

12. A package according to claim 6, characterized in that it includes an outer covering of paper or of a stretchable or shrinkable plastic material.

13. A package according to claim 7, characterized in that it includes an outer covering of paper or of a stretchable or shrinkable plastic material.

* * * * *